US005829661A

United States Patent [19]

Hirtl et al.

[11] Patent Number: 5,829,661

[45] Date of Patent: Nov. 3, 1998

[54] EXPLOSIVE POWDER CHARGE OPERATING SETTING TOOL

[75] Inventors: Anton Hirtl, Gams; Norbert Pfister, Montlingen, both of Switzerland; Günther Grosslercher, Bludenz, Austria

[73] Assignee: Hilti Aktiengesellschaft, Schaan, Liechtenstein

[21] Appl. No.: 932,798

[22] Filed: Sep. 15, 1997

[30] Foreign Application Priority Data

Oct. 14, 1996 [DE] Germany ..... 196 42 295.7

[51] Int. Cl.[6] ..... B25C 1/14

[52] U.S. Cl. ..... 227/10; 227/135; 227/139

[58] Field of Search ..... 227/10, 9, 119, 227/135, 120, 136, 138, 139, 140, 149

[56] References Cited

U.S. PATENT DOCUMENTS 3,991,925 11/1976 Büchel ..... 227/10
4,201,324 5/1980 Maier et al. ..... 227/9
4,930,673 6/1990 Pfister ..... 227/10
5,167,359 12/1992 Frommelt ..... 227/8

FOREIGN PATENT DOCUMENTS 2314920 10/1974 Germany ..... 227/10
2003075 3/1979 United Kingdom ..... 227/10

*Primary Examiner*—John Sipos
*Assistant Examiner*—Bobby Rushing, Jr.
*Attorney, Agent, or Firm*—Anderson, Kill & Olick, P.C.

[57] ABSTRACT

An explosive powder charge operated setting tool including a housing(1), a stud guide(3) projecting beyond the housing (1) in a setting direction and axially displaceable relative to the housing(1), a guide channel(4) extending substantially transverse to a longitudinal extent of the stud guide(3) for receiving a spring-biased, strip-shaped magazine for fastening elements and having side recesses, and a pivotal lever(8) provided on the stud guide(3) and cooperating with the housing(1), the lever(8) being pivotable into a blocking position, in which the lever(8) projects into a clearance cross-sectional surface of the guide channel(4) upon displacement of the stud guide(3) toward the housing(1).

6 Claims, 2 Drawing Sheets

EXPLOSIVE POWDER CHARGE OPERATING SETTING TOOL

BACKGROUND OF THE INVENTION

1. Field of the Invention

The present invention relates to an explosive powder charge operated setting tool including a housing, a stud guide projecting beyond the housing in a setting direction and axially displaceable relative to the housing, a guide channel extending substantially transverse to a longitudinal extent of the stud guide for receiving a spring-biased, strip-shaped magazine for fastening elements, and a stop projecting into a clearance cross-sectional surface of the guide channel.

2. Description of the Prior Art

International publication WO89/05214 discloses an explosive powder charge operated setting tool including a housing, a stud guide displaceable relative to the housing, a guide channel extending transverse to the longitudinal extent of the stud guide, a guide element and a stop. The guide element serves for receiving a magazine for fastening elements and includes spring elements for displacing the magazine toward the guide channel. The clearance cross-section of the guide element is located in the transition region between the stud guide and guide element and is coaxial with the clearance cross-section surface of the guide channel. The stop, which is provided on the stud guide, projects into the clearance cross-sectional surface of the guide channel and serves for aligning of a fastening element with a guide bore of the stud guide, simultaneously serving as a detent limiting the displacement of the magazine in a direction toward the stud guide.

The stop cooperates with the fastening element. After each setting process, the magazine is further displaced in the guide channel, while the driving piston returns into its initial position so that the piston rod does not project any more into the clearance cross-sectional surface of the guide channel.

In order to be able to reliably and correctly anchor a fastening element in a base, it is necessary to match the driving power with the hardness of the base, into which the fastening element is to be set in, and with the length of the fastening element. In particular, when long fastening elements are set in, the operational stroke of the driving piston is long and the used explosive powder charge is correspondingly strong. Such an explosive powder charge generates a high propellant gas pressure which, after a setting process, provides for quick return of the driving piston into its initial position. This may cause rebound of the driving piston in the ignition side region of the setting tool, so that the piston again moves at high speed in the setting direction and its piston rod again projects into the clearance cross-sectional surface of the guide element. At this, a next fastening element in the magazine, which is not yet aligned with the guide bore of the stud guide can be struck by the piston rod and be damaged. Not only the fastening element, but the driving piston itself and the stud guide can be damaged.

Accordingly, an object of the present invention is an explosive powder charge operated setting tool with which the displacement of the magazine for fastening elements take place only in the inoperative or initial position of the driving piston.

SUMMARY OF THE INVENTION

This object is achieved by providing, on the stud guide, a lever pivotable into a blocking position in which the lever projects into the clearance cross-sectional surface of the guide channel upon displacement of the stud guide toward the housing.

For actuation of the setting tool, it is necessary to press the setting tool against the base so that it is displaced along a certain path. At this, the stud guide is displaced toward the housing. This pre-setting movement is used, according to the present invention, to pivot the lever into the blocking position in which the lever projects into the clearance cross-sectional surface of the guide channel. This prevents advancement of another fastening element immediately after the previous setting process. The advancement of the next fastening element is effected with a time delay toward the end of the lifting of the setting tool off the base when the piston rod of the rebounded driving piston does not find itself in the clearance cross-section surface simultaneously with the next fastening element.

Advantageously, the lever, which pivots into the magazine advancement blocking position, cooperates with a control cam associated with the housing. The shape of the control cam can influence the speed with which the lever pivots into its blocking position, dependent on the pre-setting speed. By selecting the distance of the control cam from the housing, it is possible to make the beginning of the pivotal movement of the lever dependent on the pre-setting path.

From the manufacturing point of view, the control cam is formed as a part of a control element which is arranged between the lever and the housing and is displaceable parallel to the longitudinal extent of the stud guide. Based on the weight consideration, the control element is formed as a pin arranged on the stud guide and movable in a setting direction against a spring-biasing force. A control cam, which is provided on the pin and cooperates with the lever, can be formed, e.g., as a surface inclined in the longitudinal direction of the pin.

In order to keep the dimensions of the setting tool small, the lever advantageously pivots in a plane which extends transverse to the longitudinal extent of the stud guide. The pivot axis of the lever extends parallel to the longitudinal extent of the stud guide.

Advantageously, the lever pivots into the clearance cross-section of the guide channel against a spring-biasing force. In this way, the lever is automatically pivoted into its release position when the setting tool, after a setting process, is lifted off the base and the stud guide and the housing move away from each other.

In order that it can function as intended according to the present invention, preferably, the lever is formed as a two-arm lever, with the first arm cooperating with the magazine for the fastening elements and the second arm cooperating with the control cam. The first arm can, for example, be pressed against a strip-shaped carrier member of the magazine sidewise and project into a side recess of the magazine. Alternatively, the lever can extend into a space between following one another fastening elements which project from both sides of the magazine in a direction transverse to the longitudinal extent of the magazine. The second arm cooperates with the control cam carrying pin.

The spring, which biases the lever to its release position acts, for example, on the first arm if the control cam on the pin, which is located remotely from the magazine, cooperates with a portion of the lever adjacent to the magazine. The spring, which biases the lever to its release position, cooperates with the second arm if the control cam, which is located adjacent to the magazine, cooperates with the portion of the lever remote from magazine.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1:
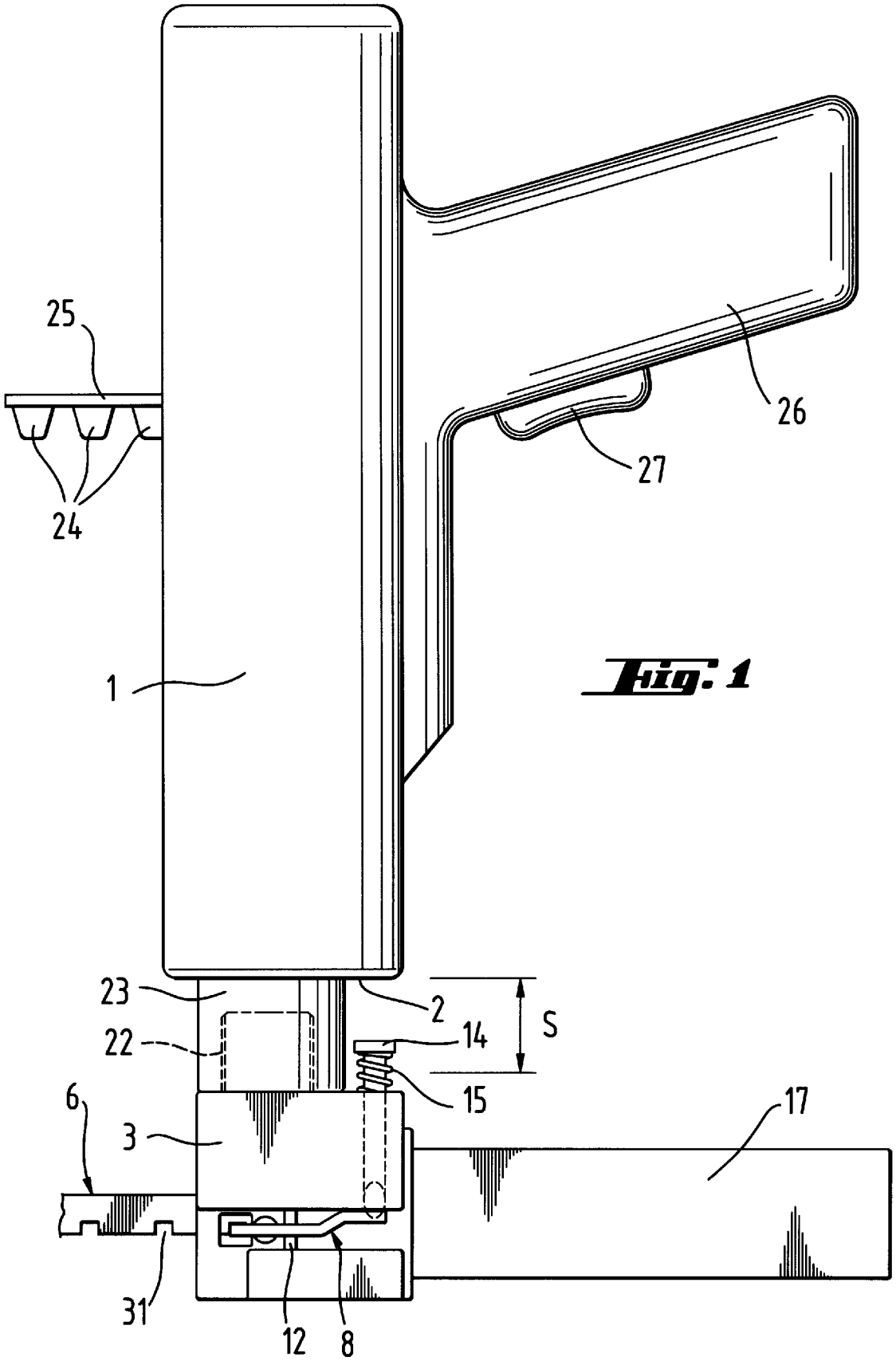
FIG. 1 shows an elevational view of an explosive powder charge operated setting tool according to the present invention in an inoperative position and without a magazine with fastening elements.

The setting tool according to the present invention, which is shown in FIG. 1, has a housing 1 having an end surface 2 facing in the setting direction. A stud guide 3 projects beyond the end surface 2 in the setting direction. In a direction opposite to the setting direction, the stud guide 3 is connected with a guide cylinder 23 by a threaded connection 22. The guide cylinder 23, which is displaceable axially relative to the housing 1, serves for receiving a driving piston, not shown. The driving piston is formed of a piston part and a piston rod projecting from the piston part in the setting direction. In its rear end region, which is opposite to the stud guide 3, the guide cylinder 23 has a cartridge chamber, not shown, for receiving a cartridge 24 with an explosive powder charge. A strip-shaped cartridge magazine 25 which partially projects, as shown in FIG. 1, from the housing 1, includes a plurality of cartridges 24 arranged one after another. A cartridge 24, which is located in the cartridge chamber, is ignited with an ignition mechanism, which adjoins the guide cylinder 23 at a side thereof opposite to the setting direction, when a firing switch 27 provided on a handle 26 is depressed.

In order to be able to ignite the cartridge 24 and thereby to effect a setting operation, the setting tool should be displaced under pressure along a path S against a base for actuating the ignition mechanism which, as it has already been mentioned above, is not shown in the drawings. At that, the housing 1 is displaced relative to the stud guide 3 and the guide cylinder 23 supported against the base.

Figure 2:
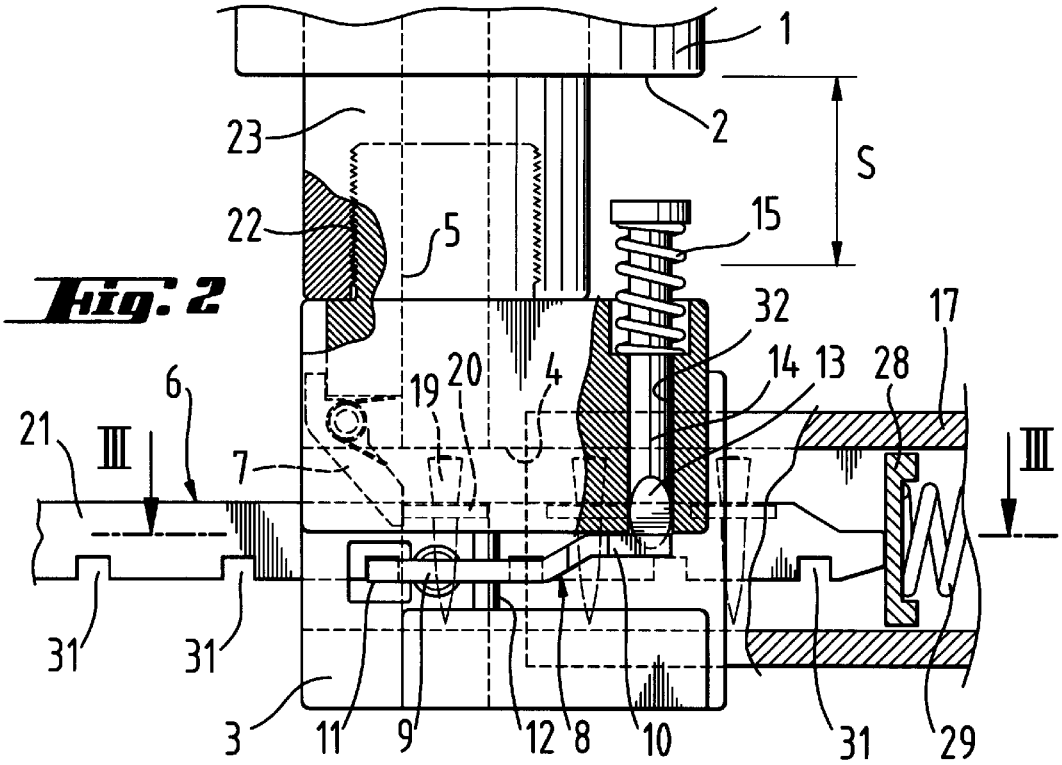
FIG. 2 shows a partially cross-sectional enlarged view of the front, in the setting direction region of the setting tool according to FIG. 1 in an inoperative position.
Figure 3:
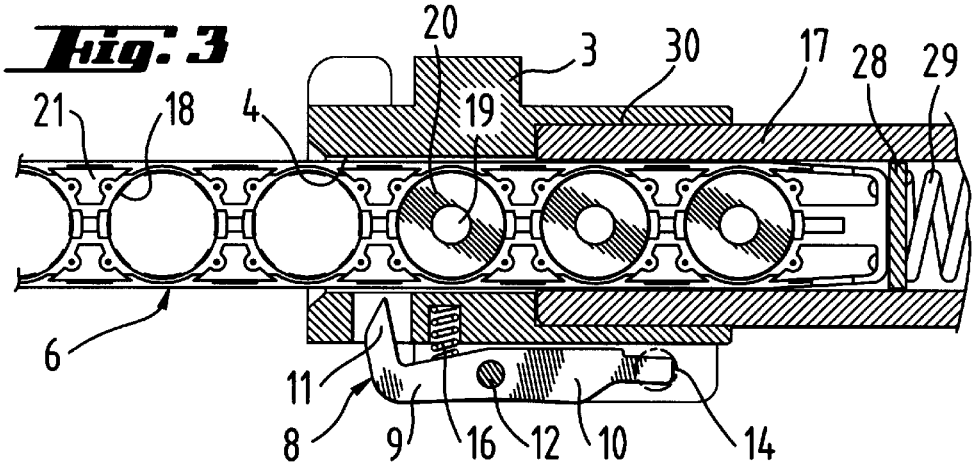
FIG. 3 shows a cross-sectional view of the front region of the setting tool according to FIG. 1 in an inoperative position along line III—III in FIG. 2.
Figure 4:
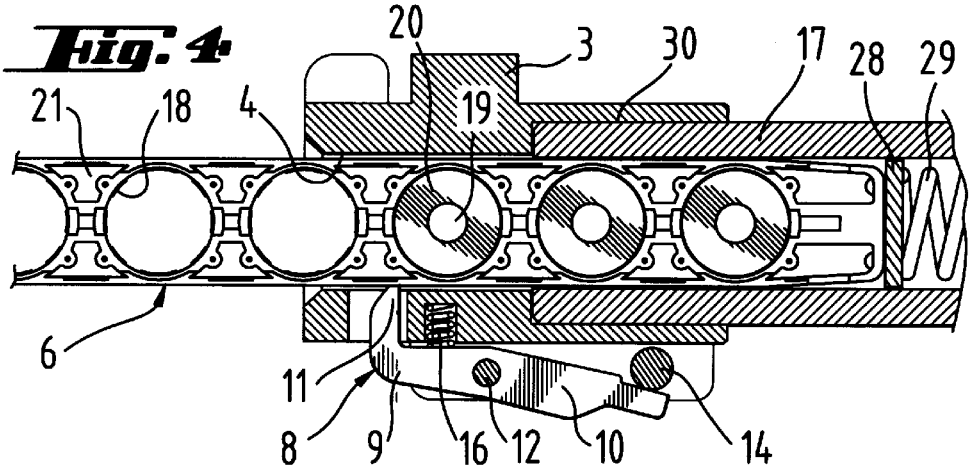
FIG. 4 shows a cross-sectional view of the front region of the setting tool according to FIG. 1 along line III—III in FIG. 2 in an application position of the setting tool.

As shown in FIGS. 2–4, a substantially sleeve-shaped guide element 17 extends sidewise of the stud guide 3. The guide element 17 is connected with the stud guide 3 by a threaded connection 30. The guide element 17 serves for receiving a strip-shaped magazine 6 for the fastening elements. The guide element 17 has a pressure plate 28 and a compression spring 29 acting on the pressure plate 28. The pressure plate 28 and a compression spring 29 provide for automatic displacement of the magazine 6, which is received in the guide element 17, in a direction toward the stud guide 3 after each setting operation. The stud guide 3 has a guide channel 4 which extends perpendicular to the longitudinal extent of the stud guide 3. The interior cross-section of the guide element 17 and the cross-sectional surface of the guide channel 4 extend coaxially relative to each other in the transition region between the stud guide 3 and the guide element 17. The strip-shaped magazine 6 for fastening elements, which is arranged inside of the guide element 17, has a plurality of circular, arranged one after another, receiving regions 18 for receiving separate fastening elements having a shape of a stud 19. The studs 19 are fixedly connected with guide washers 20, the diameter of which correspond to the diameter of the circular receiving regions 18. The studs 19 project on both sides beyond the strip-shaped carrier member 21 of the magazine 6 in the direction parallel to the longitudinal extent of the stud guide 3.

A stop 7, which is formed as a pivotal detent element, is provided on an opposing side from the guide element 17. The stop 7 extends into a clearance cross-sectional surface of the guide channel 4. After each setting operation, the magazine 6 is displaced through the guide channel 4 until another stud 19 with its guide washer 20 hits the stop 7 and is thereby axially aligned with the central guide bore 5 of the stud guide 3. During the insertion of a new magazine 6, it is pushed past the stop 7 through the guide channel 4 into the guide element 17. At that, the spring 29 is compressed by the pressure plate 28. During the insertion of a new magazine 6, the stop 7 is pivoted out of the plane of the cross-sectional surface of the guide channel 4 in the direction of the central guide bores 5.

Adjacent to the stop 7, there is provided on the stud guide 3, a pivotal lever having a detent function. The lever 8 pivots in a plane, which extends transverse to the longitudinal extent of the stud guide 3, above a pivot axis 12 extending parallel to the longitudinal axis of the stud guide 3. The lever 8 is formed as a two-arm lever, with a first arm 9 being provided with a detent tooth 11 which projects in a side recess 31 in the strip-shaped carrier member 21 of the magazine 6 in the blocking position of the lever 8. The second arm 10 of the lever 8 cooperates with a control cam 13 of a pin-shaped control element 14 which is displaceable in the setting direction against a biasing force of a spring 15 located in a bore 32 of the stud guide 3. The control cam 13 is provided in the end region of the control element 14 facing in the setting direction and is formed as a surface inclined in the setting direction. At its end opposite to the inclined surface, the control element 14 has a radial enlargement which forms an abutment for the spring 15 which surrounds the control element 14 and is supported against the stud guide 3. The inclined surface of the control element 14 is arranged opposite to the magazine 6 and cooperate, during the setting process, with a side of the lever 8 which is adjacent to the magazine 6.

A compression spring element 16, which biases the lever 8 into its release position, is arranged between the lever 8 and the stud guide 3 and between the detent tooth 11 and the rotational axis 12.

The setting process is effected as follows. At the start of the process, the driving piston, which is not shown, is in its initial position, and the magazine 6 is biased by the spring 29 toward the stud guide 3 until the guide washer 20 of a respective stud 19 abuts the stop 7. At that, the stud 19 is arranged co-axially with respect to the central guide bore 5 of the stud guide 3. The lever 8 is in its release position, and the control element 14 does not cooperate with the lever 8. This position is shown in FIGS. 2–3.

After the start of the setting process, the stud 19 is still located in the carrier member 21 of the magazine 6. The control element 14 is pressed sidewise against the lever, displacing the lever 8 into its blocking position. The detent tooth 11 of the lever 8 projects into the recess 31 of the carrier member 21. This position is shown in FIG. 4.

Though the present invention was shown and described with reference to the preferred embodiments, various modifications thereof will be apparent to this skilled in the art and, therefore, it is not intended that the invention be limited to the disclosed embodiments or details thereof, and departure can be made therefrom within the spirit and scope of the appended claims.

What is claimed is:

1. An explosive powder charge operated setting tool, comprising a housing(1); a stud guide(3) projecting beyond the housing(1) in a setting direction and axially displaceable relative to the housing(1); a guide channel(4), extending substantially transverse to a longitudinal extent of the stud guide(3) for receiving a spring biased, strip-shaped magazine for fastening elements; a stop(7) projecting into a clearance cross-sectional surface of the guide channel(4); and a pivotal lever(8) provided on the stud guide(3) and pivotable about an axis substantially parallel to said longitudinal extent of said stud guide into a blocking position, in which the lever(8) projects into a clearance cross-sectional surface of the guide channel(4) upon displacement of the stud guide(3) toward the housing(1) to block movement of said fastening elements.

2. A setting tool as set forth in claim 1, wherein the lever(8) cooperates with a control cam (13) associated with the housing(1).

3. A setting tool as set forth in claim 1, further comprising a control element(14) having a control cam(13), the control element(14) being arranged between the lever(8) and the housing(1) and being displaceable parallel to a longitudinal extent of the stud guide(3).

4. A setting tool as set forth in claim 3, wherein the control element(14) is arranged on the stud guide(3) and is formed as a pin displaceable in the setting direction against a spring-biasing force.

5. A setting tool as set forth in claim 1, wherein the lever(8) is pivoted into the blocking position thereof against a spring-biasing force imparted by spring means(16).

6. A setting tool as set forth in claim 5, wherein the lever(8) is formed as a two-arm lever, with a first arm(9) cooperating with the magazine(6) and a second arm(10) cooperating with the control cam(13).

* * * * *